United States Patent [19]

Fehrenbacher

[11] 4,308,606

[45] Dec. 29, 1981

[54] CLOCK WITH ROTARY PENDULUM

[75] Inventor: Wolfgang Fehrenbacher, St. Georgen, Fed. Rep. of Germany

[73] Assignee: Kundo-Kieninger & Obergfell, St. Georgen, Fed. Rep. of Germany

[21] Appl. No.: 141,151

[22] Filed: Apr. 17, 1980

[30] Foreign Application Priority Data

| | | | |
|---|---|---|---|
| Apr. 19, 1979 | [DE] | Fed. Rep. of Germany | 2915855 |
| Apr. 19, 1979 | [DE] | Fed. Rep. of Germany | 2915856 |
| Apr. 19, 1979 | [DE] | Fed. Rep. of Germany | 2915857 |
| Apr. 19, 1979 | [DE] | Fed. Rep. of Germany | 2915858 |

[51] Int. Cl.[3] ..... G04B 17/02

[52] U.S. Cl. ..... 368/180; 368/165; 368/287

[58] Field of Search ..... 368/179, 180, 181, 183, 368/165, 287

[56] References Cited

FOREIGN PATENT DOCUMENTS

| | | | |
|---|---|---|---|
| 2345130 | 3/1975 | Fed. Rep. of Germany . | |
| 2354226 | 7/1975 | Fed. Rep. of Germany | 368/180 |
| 7536988 | 11/1975 | Fed. Rep. of Germany . | |
| 2713488 | 5/1978 | Fed. Rep. of Germany | 368/180 |
| 1563579 | 4/1969 | France | 368/180 |
| 790810 | 2/1958 | United Kingdom | 368/180 |

*Primary Examiner*—Ulysses Weldon

*Attorney, Agent, or Firm*—Karl F. Ross

[57] ABSTRACT

A rotary pendulum without time-keeping function, comprising an inertial body suspended from a clockwork housing of a preferably electronically driven timepiece through the intermediary of an elongate torsion spring, is periodically accelerated by the impact between a vane on the spring and radial camming teeth of an impeller wheel frictionally entrained on a horizontal seconds shaft of the timepiece via a spiral spring anchored to that shaft. The vane, near the upper end of the torsion spring, oscillates only through a half-cycle limited on the return swing by an abutment on the clockwork housing. The inertial body is secured to a latch member at the lower end of the torsion with the aid of a coupling ring on which a drag ring is rotatably mounted, the latter carrying a radial fin engageable with a fixed stop pin as well as with a peripheral lug on the coupling ring whereby the body can turn through almost two full revolutions before being positively arrested. The upper end of the torsion spring is anchored to the housing through a vertically guided coil spring designed to absorb axial shocks; the inertial body is provided at its underside with a central stud received with clearance in a guide bore of an underlying base on which it bottoms whenever such shocks reach a certain intensity.

34 Claims, 9 Drawing Figures

CLOCK WITH ROTARY PENDULUM

FIELD OF THE INVENTION

My present invention relates to a clock provided with a rotary pendulum, especially an ornamental one without time-keeping function (sometimes referred to as a nonfunctional or blind pendulum) of the general type described in my prior U.S. Pat. No. 3,990,226.

BACKGROUND OF THE INVENTION

A rotary pendulum of the kind here contemplated comprises an inertial body of large mass suspended from a mounting on the clockwork housing of the timepiece through the intermediary of an elongate element which may be designed as a torsion spring, i.e. a wire or blade of elastic material and negligible mass compared to that of the inertial body, but which could also be a rigid rod rotatably journaled in the clock housing and subjected to a spring force tending to maintain it in a predetermined angular position. In a clock described in a commonly owned U.S. application, Ser. No. 889,435 filed Mar. 23, 1979 by Erich Scheer et al. now abandoned, the pendulum body is rotatably supported on an advantageously nonrotating rod surrounded by a coil spring which is fixedly anchored at its upper end and whose lower end is secured to that body. In all these instances, rotational oscillations of the pendulum about a vertical axis are sustained by undirectional impulses periodically imparted to a lateral extension of the body-supporting element by an impeller which is continuously or quasi-continuously driven by the clockwork, the latter being preferably operated electronically by a crystal-controlled oscillator. According to my aformentioned prior U.S. patent, the impeller may be a cam wheel or disk having a pair of diametrically opposite protuberances alternately engaging a horizontal spur on the torsion spring while that spur rests against a fixed stop. The spur is carried on the torsion spring at a point close to its clamped upper extremity so that the natural frequency of the pendulum is only slightly increased during the half-cycle in which the spur is immobilized by the stop.

In order to protect such a rotary pendulum against accidental damage due to shocks during transportation and handling, various means are known for immobilizing it when the clock is not in use. These precautions, however, are often disregarded by a user who may not even be aware of the existence of such a protective device. According to a prior innovation of mine, described in commonly owned German published specification No. 23, 54 226 filed Oct. 30, 1973, a friction clutch including a coil spring is inserted between the lower extremity of the torsion spring and the inertial body of the pendulum to relieve both longitudinal and torsional overstresses to which the torsion spring may be subjected when the clock is brusquely lifted off a mantelpiece, for example, or when playing children, after removing the protective glass cover usually provided for such timepiece, turn the pendulum body about its axis beyond its normal oscillatory range. That published German publication also teaches the provision of a cup-shaped guide on a base plate underlying the inertial body whose underside has a central stud received with clearance in the cup in order to come to rest on the bottom thereof when the compression of the connecting coil spring reaches a certain degree.

The arrangement just described fulfills its purpose only when the pressure exerted by the coil spring on the friction clutch suffices to prevent any slip between the torsion spring and the inertial body during normal operation but allows such slip to occur when the torque applied to that body approaches a permissible limit representing a maximum twist to which the torsion spring may be safely subjected. Upon prolonged use, however, the clutch faces may wear and the coil spring may fatigue whereby slippage may interfere with the rotary oscillation sought to be sustained.

Since the oscillatory cycle of a rotary pendulum differs as a rule from the recurrence period of the mechanical impulses that can be imparted to the elongate body-supporting element by a clockwork-driven impeller rotating at constant speed, means must be provided for decoupling that impeller from the clockwork whenever its motion is temporarily halted by its engagement with a spur-like extension of that element. In my above-identified prior U.S. patent I have disclosed a transmission including a driving gear and a pinion normally in mesh with each other, the pinion being disengageable from the gear and thus from the clockwork during a phase of an oscillatory cycle in which a tooth of the impeller disk encounters the arrested spur. Such decoupling may also be necessary in the absence of a backstop in order to prevent possible jamming of the clockwork when, for example, the rotary pendulum is willfully arrested in a position in which its spur lies in the orbit of an impeller tooth.

OBJECTS OF THE INVENTION

An important object of my present invention is to provide an improved impeller mechanism with simple decoupling means for the purpose set forth.

Another object is to provide shock-absorbing means for a torsion spring of such a pendulum, preferably in combination with twist-limiting means, designed to remain effective over a long period.

A further object is to provide a detachable connection between the inertial body and its supporting element which allows either of these constituents to be readily replaced whenever that is necessary or desirable.

Still another object, allied with the preceding one, is to provide a braking mechanism for an inertial pendulum body detachably connected to a suspension element.

SUMMARY OF THE INVENTION

In accordance with a feature of my present invention I provide, in a timepiece of the above-described type, an impeller wheel with an annular rim idling on a shaft of the clockwork, e.g. its seconds shaft. A nave fixedly secured to that shaft defines with the wheel rim an annular space in which a spiral spring is lodged, that spring being anchored to the nave and bearing frictionally with its outermost turn upon the inner periphery of the rim. Advantageously, that outermost turn has a free end trailing in the direction of shaft rotation whereby a retardation of the wheel relative to the shaft diminishes the frictional coupling therebetween.

In accordance with another feature of my invention, the mounting means for the upper extremity of a torsion spring supporting the inertial pendulum body comprises a resilient link between that extremity and the clockwork housing; the pendulum body has a stud received with clearance in a guide bore of a base on whose bottom the stud comes to rest, in a manner known per se from the aforementioned German specification No. 23 54 266, in response to an axial shock causing a predetermined degree of deformation of the link. The latter advantageously is a compressible coil spring surrounding a bolt which has a head nonrotatably slidable in a vertical guide sleeve forming part of the torsion-spring mounting, the bolt head being overlain by closure means which may be part of a downwardly and laterally open seat for the sleeve.

A further feature of my invention, advantageously used in combination with the resilient link referred to above, resides in the provision of a mechanical brake for impeding rotation of the inertial body beyond a predetermined oscillatory stroke, this body having a cylindrical neck attached to the lower extremity of the torsion spring and surrounded with slight friction by a drag ring which has a projecting formation arrestable by a fixed abutment on the clockwork housing in two angular positions spaced nearly 360° apart.

Pursuant to still another feature of my invention, the aforementioned neck has a throughgoing diametrical passage receiving a bifurcate anchor member on the lower end of the elongate suspension element. The coupling ring, nonrotatably but slidably mounted on the neck, is releasably engaged by prongs of the anchor member. When the pendulum body is provided with a brake mechanism including the above-mentioned drag ring, the latter may rest on the coupling ring and may be held in frictional contact therewith by gripping means such as resilient hooks rising integrally from the coupling.

I also prefer to provide the coupling ring with a lug engageable by the projecting formation of the drag ring in two relative rotary positions spaced nearly 360° apart whereby the pendulum body is free to execute almost two revolutions (one of them with frictional retardation by the drag ring) before being arrested by the fixed abutment.

BRIEF DESCRIPTION OF THE DRAWING

The above and other features of my invention will now be described in detail with reference to the accompanying drawing in which:

FIG. 1A is a fragmentary elevational view showing a detail of the pendulum on a larger scale;

SPECIFIC DESCRIPTION

Figure 1:
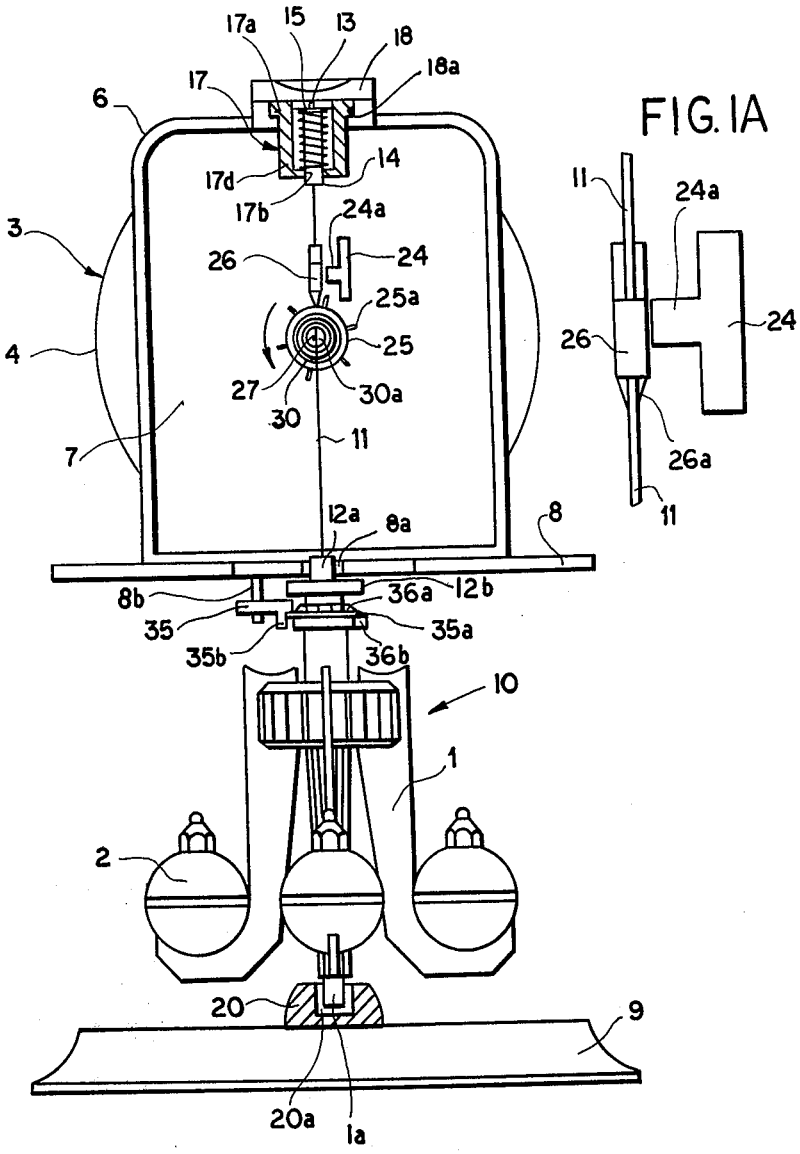
FIG. 1 is a rear-elevational view of a timepiece with a "nonfunctional" rotary pendulum embodying my invention.
Figure 2:
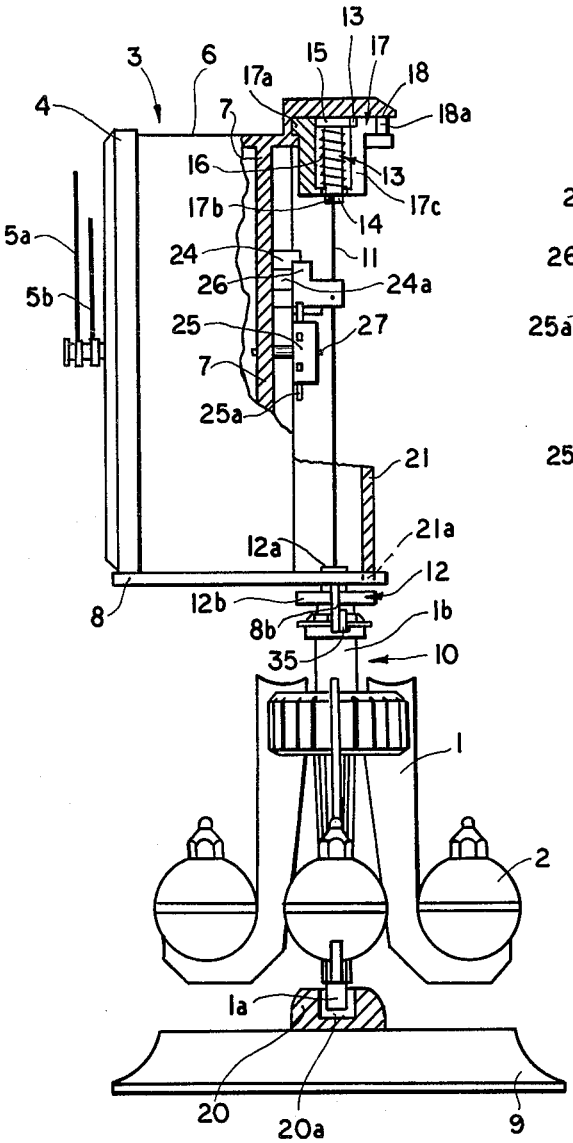
FIG. 2 is a side-elevational view of the timepiece of FIG. 1 with parts broken away.
Figure 2A:
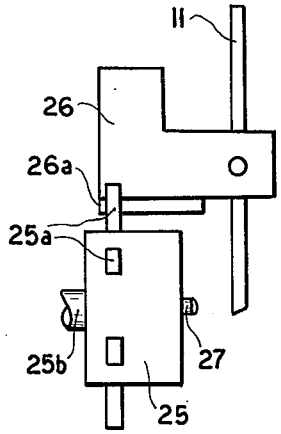
FIG. 2A is another fragmentary elevational view showing details of an impeller wheel associated with the pendulum, also on a larger scale.

In FIGS. 1 and 2 I have shown a timepiece 3 with a clockwork housing 6 and a base 9 supporting that housing by a pair of nonillustrated posts. A front plate 4 of housing 6 carries a clock face and is penetrated by the shafts of a minute hand 5*a* and an hour hand 5*b*. A seconds hand, not shown, is mounted on a shaft 27 which also passes through a rear housing wall 7 and carries an impeller wheel 25 more fully described hereinafter with reference to FIGS. 2A, 6 and 7. This impeller wheel has radial camming teeth 25*a* coacting with a vane 26 which extends laterally from a torsion spring 11 in the shape of a narrow elastic blade whose upper extremity is nonrotatably secured to a housing extension 18 and whose lower extremity is detachably connected with an inertial pendulum body 1, generally similar to that of my prior U.S. Pat. No. 3,990,226, whose mass determines together with the elasticity of element 11 the natural frequency of a rotary pendulum 10 constituted by these two components. Torsion spring 11 terminates at its lower extremity in an anchor member 12 of synthetic resin, more fully illustrated in FIGS. 3–5, which has a boss 12*a* rising from a collar 12*b* and traversing a slot 8*a* in a bottom plate 8 of housing 6. The slot, which accommodates the boss 12*a* with considerable all-around clearance, is plugged by a tab 21*a* on the lower edge of a back cover 21 illustrated only in part in FIG. 2 and omitted in FIG. 1. Also omitted is the usual protective case of glass or transparent plastic enclosing the entire clock while resting on the base 9.

Housing extension 18 forms a laterally and downwardly open holder or seat for a guide sleeve 17 which has a top flange 17*a* slidable from the rear into a track 18*a* on that seat. The upper extremity of torsion spring 11 is fastened to the shank 14 of a bolt traversing a reduced bore 17*b* at the bottom of sleeve 17. Shank 14 is enveloped by a compression spring 16 resting on the sleeve bottom and bearing from below upon the bolt head 15, this head being provided with a radial protrusion 13 sliding in a longitudinal slit 17*c* of the sleeve so as to be held against rotation. An overlying solid portion of seat 18 closes the upper end of sleeve 17 and resists the pressure of spring 16 acting upon the bolt head 15. The bolt 14, 15 may consist of plastic material molded around the top end of torsion spring 11.

In assembling the parts 14–18 I first insert the torsion spring, already attached to shank 14 surrounded by coil spring 16, into the sleeve 17 by way of its slit 17*c*. After introduction of the shank into bottom aperture 17*b*, and with head 15 depressed against the spring force to lie flush with the flange 17*a* of the sleeve, the latter is radially slid into the seat 18 to occupy its illustrated position, preferably under slight clamping pressure from the flanks of that seat. The slit 17*c* could then be blocked by a screw, pin or other suitable plug to prevent any spontaneous dislodgment of the sleeve from its seat.

Pendulum body 1, which carries a set of ornamental and relatively massive balls 2, is provided with a central stud 1*a* received with all-around clearance in a bore 20*a* of a cup 20 integral with base 9 in a quiescent position of pendulum 1 as well as during normal rotary oscillations about its vertical axis. Spring 16 presses the bolt head 15 firmly against holder 18 whereby stud 1*a* is separated by a vertical gap from the bottom of bore 20*a*. When the pendulum experiences a significant downward shock, stud 1*a* reaches the bottom of bore 20*a* and thus limits the longitudinal tension to which torsion spring 11 can be subjected. It will be noted that boss 12*a* of anchor member 12 still projects into slot 8*a* in that bottom position. During transportation, member 12 and stud 1*a* prevent major excursions of body 1 from its normal attitude without the need for special immobilization means.

Figure 4:
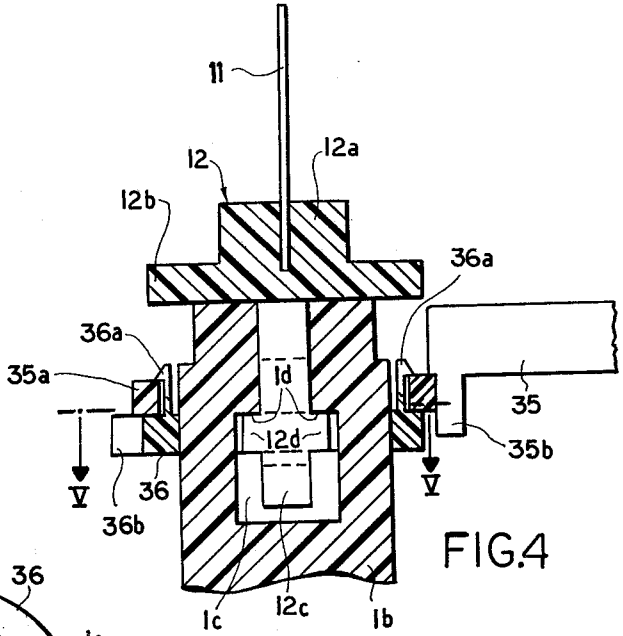
FIG. 4 is a sectional elevational view similar to that of FIG. 3 but taken at right angles thereto.
Figure 5:
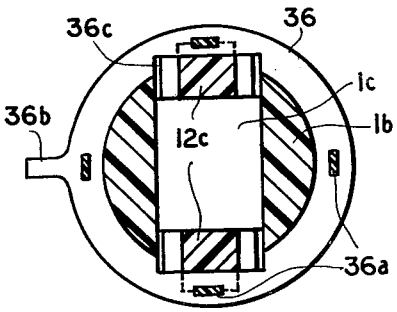
FIG. 5 is a cross-sectional view taken on the line V—V of FIG. 4.
Figure 3:
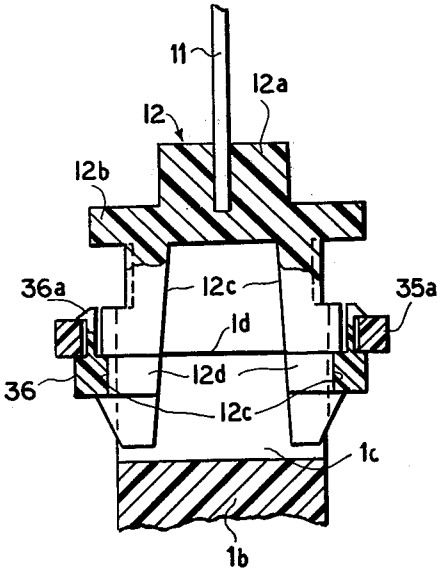
FIG. 3 is an enlarged sectional elevational view of a coupling between a torsion spring and an inertial body forming part of the pendulum.

A neck 1*b* of pendulum body 1 is provided, as illustrated in FIGS. 3–5, with a throughgoing diametrical passage 1*c* designed to receive two depending prongs 12*c* of anchor member 12 which are integral with its collar 12*b* and have wings 12*d* overhung by internal shoulders 1*d* of neck 1*b* after these prongs have been slid radially into the passage 1*c*. The free ends of prongs 12*c*, projecting resiliently outward from opposite sides of that passage, have external cutouts 12*e* which interfit with inner peripheral incisions 36*c* of a coupling ring 36; this ring is initially slidable on neck 1*b* but is held against both axial and angular displacement by its snap-type engagement with prongs 12*c*. A set of gripper hooks 36*a* integrally molded with the resinous coupling ring 36 loosely retain a drag ring 35*a* on the upper surface of ring 36 in coaxial relationship therewith; advantageously, ring 35*a* also consists of resinous material, as does neck 1*b*. Drag ring 35*a*, resting with slight frictional contact on coupling ring 36, is integral with a radially projecting fin 35 which has a depending tag 35*b* on the level of coupling ring 36. A lug 36*b* of the latter ring strikes the tab 35*b* from opposite sides upon a nearly complete revolution of ring 36 and neck 1*b* relative to drag ring 35*a*. The absolute rotation of the drag ring is also limited to slightly less than a full revolution by a fixed pin 8*b* depending from the bottom plate 8 of clockwork housing 6, this pin thus serving as an abutment which limits the swing amplitude of pendulum body 1 to about 700°. As long as that swing extends over not more than 350°, drag ring 35*a* is not restrained by the pin 8*b* and therefore does not impede the rotation of the pendulum about its axis. If an attempt is made to rotate the pendulum body beyond its normal oscillatory range, such rotation is blocked by the pin 8*b* in a position in which torsion spring 11 is not yet subjected to an inadmissible twist. Upon the subsequent release of the pendulum body, the return swing is braked by the drag ring until the amplitudes have been reduced to less than a full turn. I prefer, however, to design the pendulum and its impeller in such a way that the braking action of ring 25*a* comes into play in every cycle, even with low voltage in the case of a battery-powered clock, for ensuring substantially uniform oscillation under all operating conditions.

A detachment of body 1 from anchor member 12 and thus from torsion spring 11 requires only a slight compression of prongs 12*c* to release the coupling ring 36 which need not be separated from the drag ring 35*a* for this purpose. Such separation, however, is also readily accomplished by an inward deflection of hooks 36*a*.

Figure 6:
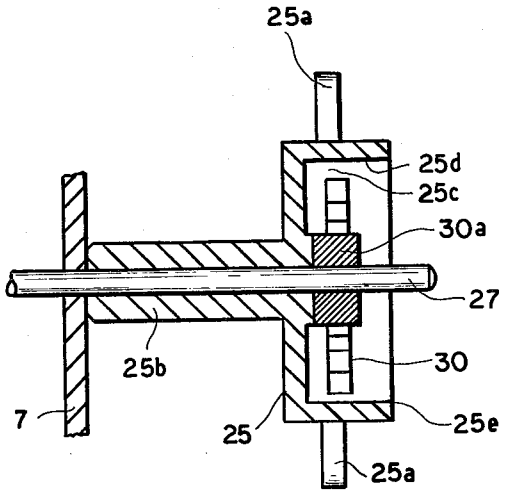
FIG. 6 is an axial sectional view of the impeller wheel illustrated in FIG. 2A, drawn to a further-enlarged scale.
Figure 7:
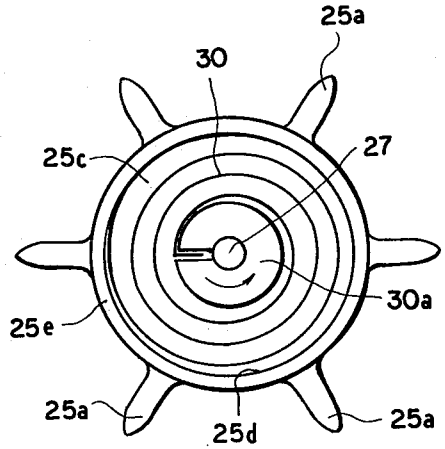
FIG. 7 is a face view of the impeller wheel shown in FIG. 6.

In FIGS. 6 and 7 I have shown details of the impeller wheel 25 having six teeth 25*a* equispaced about the outer periphery of its annular rim 25*e*. A nave 30*a* fixedly mounted on seconds shaft 27 lies within rim 25*e* and defines with it an annular space 25*c* accommodating a spiral spring 30 whose inner end is anchored to the nave 30*a* while its outermost turn is in frictional contact with the inner rim surface 25*d*. With shaft 27 rotating counterclockwise as seen in FIGS. 1 and 7, this outer turn has a free end trailing in the direction of rotation whereby a relative retardation of wheel 25 will cause the spiral spring 30 to contract and thus to reduce the frictional coupling between the wheel and its drive shaft 27. In this way, I minimize any reaction effect which a halting of wheel 25 may have upon the clockwork. If the retardation is so slight that no slippage occurs, the energy stored in spring 30 during its contraction will be released upon its subsequent re-expansion to accelerate the wheel into its prior angular position relative to shaft 27.

Wheel 25, idling on shaft 27, has a hub 25*b* which is axially immobilized between housing wall 7 and nave 30*a*. The same housing wall supports a fixed stop 24, shown in FIGS. 1, 1A and 2, which has a horizontal web 24*a* contacting the L-shaped vane 26 when the latter is in a position of substantially maximum rotational speed of pendulum body 1, i.e. when that vane lies in or near a vertical plane including the axes of pendulum 10 and impeller wheel 25 after having swung through half an oscillatory cycle to the left of that plane as viewed in FIGS. 1 and 1A. In this arrested position, toward the end of the other half-cycle carried out by body 1 at a slightly higher velocity, the vane 25 is struck by an approaching tooth 25*a* of wheel 25 with an impulse accelerating the pendulum 10 for the next cycle. The teeth 25*a*, spaced 60° apart as shown in FIG. 7, follow one another into striking position at 10-second intervals; thus, the natural frequency of the pendulum should be so chosen that the half-cycle immediately following the accelerating impulse has a duration of substantially 5½ seconds, with the entire oscillatory period lasting just over 10 seconds so that wheel 25 is halted for only a small fraction of a second.

Vane 26 has a beveled lower edge 26*a* while teeth 25*a* have pointed tips to avoid possible jamming. It should also be noted that the normal distance of edge 26*a* from the outer periphery of wheel 25 exceeds the maximum vertical travel of pendulum 10 as defined by the gap between the stud 1*a* and the bottom of bore 20*a* so that vane 26 will stay clear of the impeller wheel even when a downward shock lowers the body 1 into contact with base cup 20; the length of teeth 25*a*, of course, exceeds that distance. By the same token, the rising leg of the L-shaped vane is high enough to remain aligned with the web 24*a* of backstop 24 in any vertical position of the pendulum, and this is also true of the length of pin 8*b* with reference to fin 35.

I claim:

1. In a timepiece comprising a clockwork in a housing provided with mounting means and a rotary pendulum including an inertial body suspended from said mounting means by an elongate element having a lateral extension coacting with clockwork-driven impeller means periodically imparting thereto a unidirectional impulse for sustaining rotational oscillations of said inertial body about a vertical axis, the improvement wherein said impeller means comprises a wheel with an annular rim idling on a shaft of said clockwork, a nave fixedly secured to said shaft inside said rim, and a spiral spring in an annular space between said nave and said rim, said spiral spring being anchored to said nave and bearing frictionally with an outermost turn upon the inner periphery of said rim for yieldably coupling said wheel to said shaft, said wheel being provided with a protuberance traversing the path of said lateral extension during every revolution of said wheel.

2. A timepiece as defined in claim 1 wherein said outermost turn has a free end trailing in the direction of shaft rotation whereby a retardation of said wheel relative to said shaft diminishes the frictional coupling therebetween.

3. A timepiece as defined in claim 1 wherein said shaft is journaled in an upright wall of said housing, said wheel having a hub axially immobilized between said wall and said nave.

4. A timepiece as defined in claim 1 wherein said shaft is a seconds shaft of said clockwork, said protuberance being one of a plurality of peripherally equispaced teeth projecting radially from said rim.

5. A timepiece as defined in claim 4 wherein the number of said teeth is six, said rotary pendulum having an oscillatory half-cycle of substantially 5.5 seconds.

6. A timepiece as defined in claim 4 wherein said elongate element is resiliently supported by said mounting means with limited vertical mobility, the length of said teeth being sufficient to intercept said lateral extension in any vertical position of said elongate element.

7. A timepiece as defined in claim 4, 5 or 6 wherein said teeth have pointed tips and said lateral extension is a vane with a beveled horizontal edge facing said rim.

8. A timepiece as defined in claim 1 wherein said elongate element is a torsion spring with an upper extremity held against rotation by said mounting means, said lateral extension being carried on a part of said torsion spring near said upper extremity, further comprising fixed stop means on said housing for arresting said lateral extension on a return swing thereof, opposite the direction of the impulse imparted thereto by said impeller means, in a position of substantially maximum rotational speed of said inertial body.

9. A timepiece as defined in claim 8 wherein said elongate element is resiliently supported on said mounting means with limited vertical mobility, said stop means being of sufficient height to intercept said lateral extension in any vertical position thereof.

10. A timepiece as defined in claim 1, 6, 8 or 9 wherein said mounting means comprises a vertical guide sleeve with a reduced bottom aperture, a bolt with a head nonrotatably slidable in said sleeve and with a shank traversing said bottom aperture, and a coil spring in said guide sleeve surrounding said shank, said bolt being rigidly secured to said elongate element.

11. A timepiece as defined in claim 10 wherein said housing is provided with a base overhung by said rotary pendulum, said inertial body having a stud centered on said vertical axis and received with clearance in a guide bore of said base, said stud being normally spaced from the bottom of said bore and coming to rest thereon in response to an axial shock causing a predetermined degree of compression of said coil spring.

12. A timepiece as defined in claim 1 wherein said inertial body has a cylindrical neck attached to said elongate element, further comprising a drag ring surrounding said neck with slight friction, said drag ring being provided with a projecting formation, and an abutment fixed to said housing and disposed in the path of said formation for arresting said drag ring in two angular positions thereof spaced nearly 360° apart.

13. A timepiece as defined in claim 12 wherein said neck has a lug engageable by said formation in either of two rotary positions of said drag ring relative to said inertial body spaced nearly 360° apart whereby said inertial body is rotatable through almost two revolutions before being arrested by said abutment.

14. A timepiece as defined in claim 12 or 13 wherein said elongate element has a lower extremity terminating in an anchor member detachably secured to said inertial body by a coupling ring nonrotatably mounted on said neck, said drag ring being supported on said neck through said coupling ring.

15. In a timepiece comprising a clockwork in a housing provided with mounting means, an elongate torsion spring having an upper extremity nonrotatably secured to said mounting means, an inertial body attached to a lower extremity of said torsion spring and forming therewith a rotary pendulum overhanging a base which is part of said housing, and impeller means driven by said clockwork for periodically imparting a unidirectional impulse to a lateral extension of said torsion spring for sustaining rotational oscillations of said pendulum about a vertical axis, the improvement wherein said mounting means comprises a resilient link between said housing and said upper extremity, said inertial body having a stud received with clearance in a guide bore of said base, said stud being normally spaced from the bottom of said bore and coming to rest thereon in response to an axial shock causing a predetermined degree of deformation of said link.

16. A timepiece as defined in claim 15 wherein said resilient link is a compressible coil spring, said mounting means further comprising a vertical guide sleeve with a reduced bottom aperture, a bolt with a head nonrotatably slidable in said sleeve and with a shank traversing said bottom aperture, said coil spring surrounding said shank and bearing from below upon said head, and closure means overlying said head, said torsion spring being rigidly secured to said shank.

17. A timepiece as defined in claim 16 wherein said housing is provided with a laterally and downwardly open seat for said sleeve, said closure means being part of said seat.

18. A timepiece as defined in claim 16 or 17 wherein said sleeve is provided with a longitudinal slot, said bolt being provided with a radial protrusion received in said slot for preventing relative rotation between said bolt and said sleeve.

19. A timepiece as defined in claim 15, 16 or 17 wherein said pendulum is provided with mechanical brake means for impeding rotation of said inertial body beyond a predetermined oscillatory stroke.

20. A timepiece as defined in claim 19 wherein said inertial body has a cylindrical neck attached to said lower extremity, said brake means comprising a drag ring which surrounds said neck with slight friction and is provided with a projecting formation, said housing being provided with a fixed abutment extending into the path of said formation for arresting said drag ring in two angular positions thereof spaced nearly 360° apart.

21. A timepiece as defined in claim 20 wherein said brake means further comprises a lug on said neck engageable by said formation in two relative rotary positions spaced nearly 360° apart whereby said inertial body is rotatable through almost two revolutions before being arrested by said abutment.

22. A timepiece as defined in claim 20 wherein said lower extremity terminates in an anchor member detachably secured to said inertial body by a coupling ring nonrotatably mounted on said neck below said drag ring.

23. A timepiece as defined in claim 22 wherein said drag ring rests on said coupling ring, the latter being provided with gripping means holding said drag ring in frictional contact therewith.

24. A timepiece as defined in claim 20 wherein said abutment is a vertical pin of sufficient length to intercept said formation in any vertical position of said inertial body.

25. A timepiece as defined in claim 15 or 16 wherein said impeller means comprises a wheel on a horizontal shaft of said clockwork provided with at least one radial tooth traversing the path of said lateral extension during every revolution of said wheel, the length of said tooth exceeding the maximum vertical stroke of said pendulum.

26. A timepiece as defined in claim 25 wherein said lateral extension is carried on a part of said torsion spring near said upper extremity oscillating through a small fraction of a circle during a full revolution of said inertial body; further comprising fixed stop means on said housing for arresting said lateral extension on a return swing thereof, opposite the direction of the impulse imparted thereby by said tooth, in a position of substantially maximum rotational speed of said inertial body, said stop means being of sufficient height to intercept said lateral extension in any vertical position thereof.

27. In a timepiece comprising a clockwork in a housing provided with mounting means, an elongate torsion spring having an upper extremity nonrotatably secured to said mounting means, an inertial body attached to a lower extremity of said torsion spring and forming therewith a rotary pendulum overhanging a base which is part of said housing, and impeller means driven by said clockwork for periodically imparting a unidirectional impulse to a lateral extension of said torsion spring for sustaining rotational oscillations of said pendulum about a vertical axis, the improvement wherein said inertial body has a cylindrical neck attached to the lower extremity of said torsion spring, further comprising a drag ring rotatably surrounding said neck with slight fraction and carrying a projecting formation, said housing being provided with a fixed abutment extending into the path of said formation for arresting said drag ring in two angular positions thereof spaced nearly 360° apart.

28. A timepiece as described in claim 27, further comprising a lug on said neck engageable by said formation in two relative rotary positions spaced nearly 360° apart whereby said inertial body is rotatable through almost two revolutions before being arrested by said abutment.

29. In a timepiece comprising a clockwork in a housing provided with mounting means and a rotary pendulum including an inertial body suspended from said mounting means by an elongate element having a lateral extension coacting with clockwork-driven impeller means periodically imparting thereto a unidirectional impulse for sustaining rotational oscillations of said inertial body about a vertical axis, the improvement wherein said elongate element has a lower extremity terminating in a bifurcate anchor member and said inertial body is provided with a cylindrical neck having a throughgoing diametrical passage receiving said anchor member, further comprising a coupling ring nonrotatably but slidably mounted on said neck, said anchor member having prongs releasably engaged by said coupling ring.

30. A timepiece as defined in claim 29 wherein said pendulum is provided with mechanical brake means for impeding rotation of said inertial body beyond a predetermined oscillatory stroke, said brake means comprising a drag ring rotatably surrounding said neck and resting with slight friction on said coupling ring, said drag ring being provided with a projecting formation engageable with a fixed abutment on said housing in two angular positions spaced nearly 360° apart.

31. A timepiece as defined in claim 30 wherein said coupling ring is provided with a lug engageable by said formation in two relative rotary positions spaced nearly 360° apart whereby said inertial body is rotatable through almost two revolutions before being arrested by said abutment.

32. A timepiece as defined in claim 30 or 31 wherein said coupling ring is provided with gripping means holding said drag ring in frictional contact therewith.

33. A timepiece as defined in claim 32 wherein said gripping means comprises a plurality of angularly spaced-apart resilient hooks integrally rising from said coupling ring.

34. A timepiece as defined in claim 29, 30 or 31 wherein said prongs are resilient and have wings overhung by internal shoulders of said neck inside said passage, said coupling ring being snap-fitted into external cutouts of said prongs projecting radially from said passage.

* * * * *